US006416090B1

(12) United States Patent
Schechtel et al.

(10) Patent No.: US 6,416,090 B1
(45) Date of Patent: Jul. 9, 2002

(54) LOCKING MECHANISM FOR AN ENCLOSURE

(75) Inventors: Kevin J. Schechtel, Arlington Heights; William L. Bollig, Elk Grove, both of IL (US)

(73) Assignee: 3Com Corporation, Rolling Meadows, IL (US)

( * ) Notice: Subject to any disclaimer, the term of this patent is extended or adjusted under 35 U.S.C. 154(b) by 0 days.

(21) Appl. No.: 09/386,986

(22) Filed: Aug. 31, 1999

(51) Int. Cl.[7] ..... E05C 19/00
(52) U.S. Cl. ..... 292/303; 361/726; 292/120
(58) Field of Search ..... 292/116, 117, 292/120, 303, 13, 31, 19, 20; 220/323, 780; 361/724–727

(56) References Cited

U.S. PATENT DOCUMENTS 4,967,902 A * 11/1990 Sobel ..... 206/63.3
4,993,762 A * 2/1991 Rogers ..... 292/303
5,106,143 A * 4/1992 Soeters ..... 296/37.8
5,398,162 A * 3/1995 Bice ..... 361/732
5,402,309 A * 3/1995 Ohgami ..... 361/685
5,548,643 A * 8/1996 Dalgleish ..... 379/429
6,125,668 A * 10/2000 Belden ..... 70/57.1

* cited by examiner

*Primary Examiner*—Gary Estremsky
(74) *Attorney, Agent, or Firm*—Baniak Pine & Gannon

(57) ABSTRACT

A locking mechanism for an enclosure includes a top housing member and a bottom housing member having at least one latch portion. The top housing member includes at least one top housing deflecting tab portion for deflecting the latch portion. The bottom housing member includes at least one bottom housing retaining tab portion. The top housing deflecting tab portion is slidably engaged with the bottom housing retaining tab portion to secure the top housing member to the bottom housing member and to prevent movement of the top housing member relative to the bottom housing member.

7 Claims, 3 Drawing Sheets

LOCKING MECHANISM FOR AN ENCLOSURE

FIELD OF THE INVENTION

This invention relates generally to the field of protective enclosures, and in particular, to a locking mechanism for a modem enclosure.

BACKGROUND OF THE INVENTION

Enclosures for conventional modems typically include a first shell portion (typically a base portion) and a second shell portion (typically a cover portion) that is fastened to the first shell portion. The first and second shell portions are each typically comprised of plastic.

Attempts have been made to fasten the first and second shell portions together with a plurality of conventional fasteners such as, for example, screws or bolts. However, the number of conventional fasteners required for each modem enclosure greatly increases the bill of materials (BOM) costs. Moreover, fastening the first and second shell portions together with conventional fasteners is labor intensive and results in increased manufacturing costs.

In addition to the above, attempts have been made to provide a means to fasten the first and second shell portions together without the use of separate conventional fasteners. For example, attempts have been made to provide a latch mechanism to fasten the first and second shell portion together. Typically, either the first or second shell portion includes a plurality of cantilevered beam elements that are integrally formed with the shell portion and extend outward from the shell portion in a direction along the "Z" axis. The other shell portion includes a plurality of retaining members that are aligned with the beam elements. When the first and second shell portions are positioned together, the beam elements deflect in a direction along the "X" axis when they contact the retaining members. Once the beam elements pass the retaining members, they return to their undeflected state and are retained by the retaining members.

The disadvantage of conventional integrally formed latch mechanisms is that they oftentimes fail when the assembled enclosure is subject to certain forces during impact testing. This is due to the fact that they typically only provide a retaining force in one direction such as, for example, in a direction along the "Z" axis. Moreover, the latch mechanisms are typically the primary means holding the two shells of the enclosure together. As a result, if a force is applied to the outer shell in a direction along the "Z" axis, the latch mechanism may be susceptible to failure, which in turn may result in the separation of the two shells.

Also, difficulties arise in assembling enclosures with conventional latch mechanisms due to the insertion forces generated by the plurality of beam elements and the corresponding retaining members. The disassembly of the enclosure may be particularly difficult due to the high separation force that must be applied to the first and second shell portions to cause the plurality of beam elements to disengage from the plurality of retaining members. Finally, mechanical degradation of the beam elements and the retaining portions typically results when the enclosure is disassembled. As a result, the enclosure cannot be reassembled after it has been disassembled for the first time.

Accordingly, it would be desirable to have a locking mechanism for an enclosure that overcomes the disadvantages described above.

SUMMARY OF THE INVENTION

One aspect of the invention provides a locking mechanism for an enclosure including a top housing member and a bottom housing member. The bottom housing member includes at least one latch portion. The top housing member includes at least one top housing deflecting tab portion for deflecting the latch portion. The bottom housing member also includes at least one bottom housing retaining tab portion. The top housing deflecting tab portion is slidably engaged with the bottom housing retaining tab portion to secure the top housing member to the bottom housing member and to prevent movement of the top housing member relative to the bottom housing member.

Another aspect of the invention provides a locking mechanism for a modem enclosure including a top housing member and a bottom housing member. The bottom housing member includes at least one latch portion to prevent movement of the top housing member relative to the bottom housing member in a first direction. The top housing member includes at least one top housing deflecting tab portion for deflecting the latch portion. The bottom housing member further includes at least one bottom housing retaining tab portion. The top housing deflecting tab portion is slidably engaged with the bottom housing retaining tab portion in a second direction to secure the top housing member to the bottom housing member and to prevent movement of the top housing member relative to the bottom housing member in a third direction. The first direction may preferably be an arcuate path that allows the top housing member to disengage from the bottom housing member. The second direction may preferably be an arcuate path that allows the top housing member to engage with the bottom housing member. The second direction may preferably be opposite the first direction. The third direction may preferably be a vertical path that allows the top housing member to separate from the bottom housing member. The at least one top housing deflecting tab portion may comprise two top housing deflecting tab portions, and the at least one latch portion may comprise two latch portions. The at least one bottom housing retaining tab portion may comprise eight bottom housing retaining tab portions. The top housing member may further include at least one top housing retaining tab portion. The at least one top housing retaining tab portion may preferably be slidably engaged with the at least one bottom housing retaining tab portion. The at least one top housing retaining tab portion may comprise six top housing retaining tab portions. The at least one latch portion may preferably include an end portion having a rib portion. The bottom housing member may preferably include a perimeter portion, and the at least one latch portion and the at least one bottom housing retaining tab portion may each be positioned along the perimeter portion. Similarly, the top housing member may preferably include a perimeter portion, and the at least one top housing defecting tab portion may be positioned along the perimeter portion. The top and bottom housing members may each be formed from a single piece of insulative material. The insulative material may preferably be plastic.

Another aspect of the invention provides a method of operating a locking mechanism. A top housing member and a bottom housing member are provided. The bottom housing member includes at least one latch portion. The top housing member includes at least one top housing deflecting tab portion. The bottom housing member includes at least one bottom housing retaining tab portion. The top housing deflecting tab portion is slidably engaged with the bottom housing retaining tab portion. The latch portion is deflected by the at least one top housing deflecting tab portion. The top housing member is secured to the bottom housing member thereby preventing movement of the top housing member relative to the bottom housing member.

Another aspect of the invention provides a method of operating a locking mechanism for a modem enclosure. A top housing member and a bottom housing member are provided. The bottom housing member includes at least one latch portion. The top housing member includes at least one top housing deflecting tab portion. The bottom housing member includes at least one bottom housing retaining tab portion. The latch portion is deflected by the at least one top housing deflecting tab portion. The top housing deflecting tab portion is slidably engaged with the bottom housing retaining tab portion in a second direction. The top housing member is secured to the bottom housing member, and movement of the top housing member relative to the bottom housing member in a first direction is prevented. Movement of the top housing member relative to the bottom housing member in a third direction is also prevented. The first direction may preferably be an arcuate path that allows the top housing member to disengage from the bottom housing member. The second direction may preferably be an arcuate path that allows the top housing member to engage with the bottom housing member. The third direction may preferably be a vertical path that allows the top housing member to separate from the bottom housing member. The top housing member may preferably be positioned against the bottom housing member, and the top housing deflecting tab portion may preferably contact with the bottom housing retaining tab portion. The latch portion may preferably be deflected to allow movement of the top housing member relative to the bottom housing member in the first direction. The top housing member may preferably be disengaged from the bottom housing member.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PRESENTLY PREFERRED EMBODIMENTS

Figure 1:
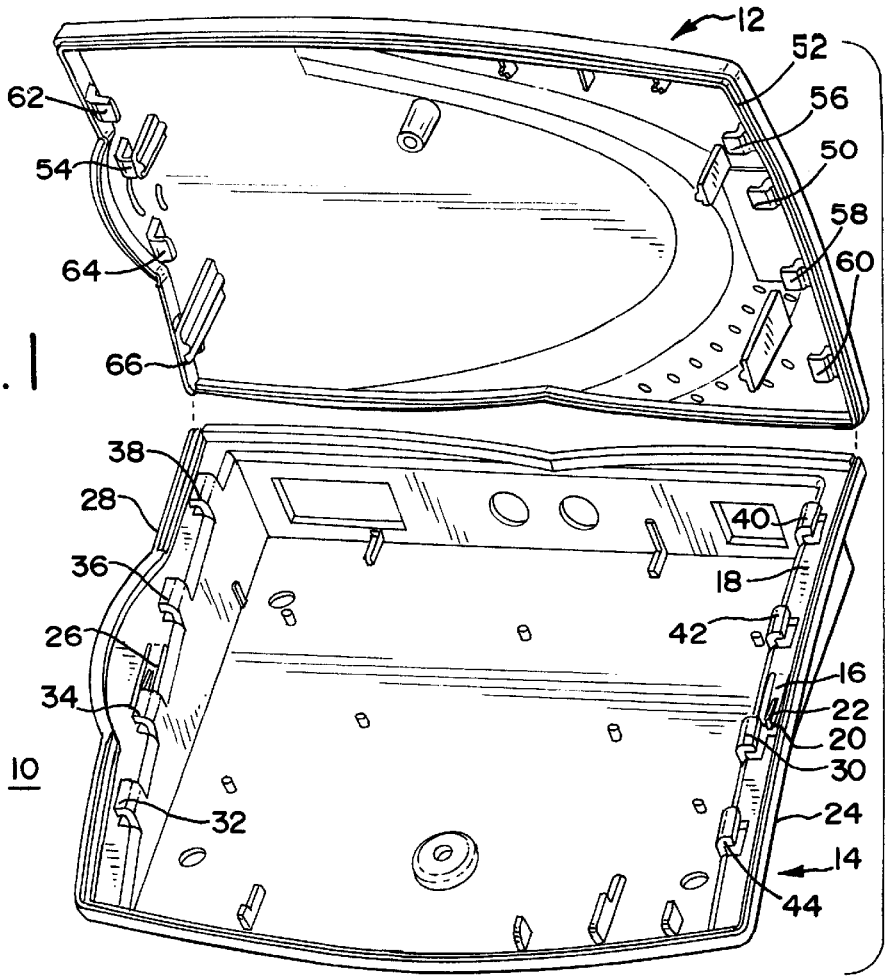
FIG. 1 is an exploded perspective view of a preferred embodiment of a locking mechanism for an enclosure which is made in accordance with the invention.
Figure 2:
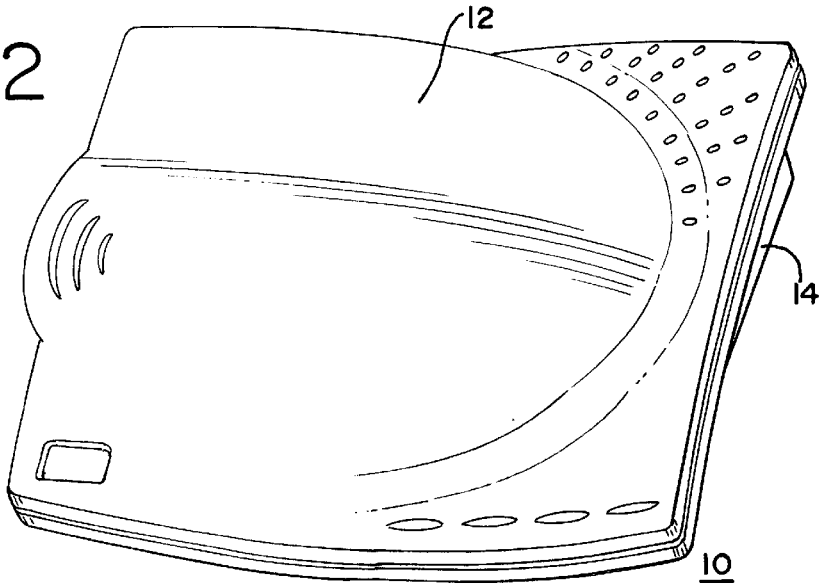
FIG. 2 is an assembled view of the embodiment of FIG. 1.

Referring to FIGS. 1–2, a preferred embodiment of a locking mechanism for an enclosure 10 includes a top housing member 12 and a bottom housing member 14. The enclosure 10 may preferably be any enclosure including, for example, an enclosure for an electronic device such as a modem. As shown in FIGS. 1–2, the top housing member 12 and the bottom housing member 14 may each be formed from a single piece of insulative material such as, for example, plastic. The plastic may preferably be flame retardant to meet UL requirements, and may consist of, for example, polycarbonate ABS plastic. In the embodiment shown, the bottom housing member 14 has a generally rectangular shape, although other shapes and configurations are contemplated. In the embodiment shown, the top housing member 12 also has a generally rectangular shape, and is adapted to mate with the bottom housing member 14.

Figure 3:
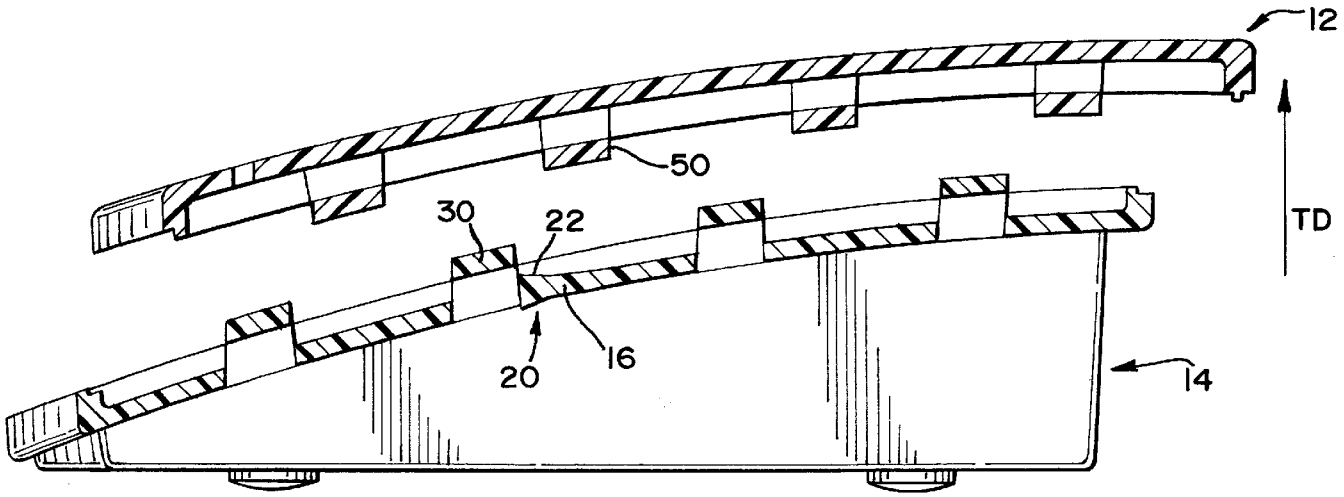
FIG. 3 is a sectional view showing the top housing member exploded from the bottom member.
Figure 5:
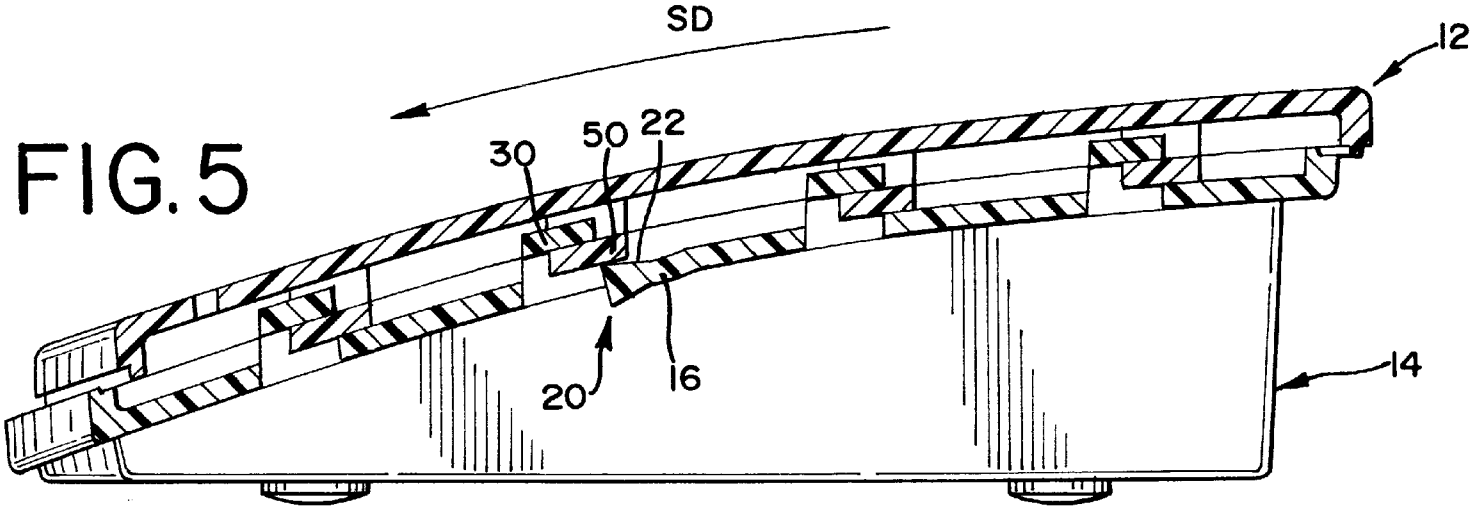
FIG. 5 is the embodiment of FIG. 4 showing the top housing deflecting tab portion slidably engaged with the bottom housing retaining tab portion and the latch portion in a deflected state.
Figure 6:
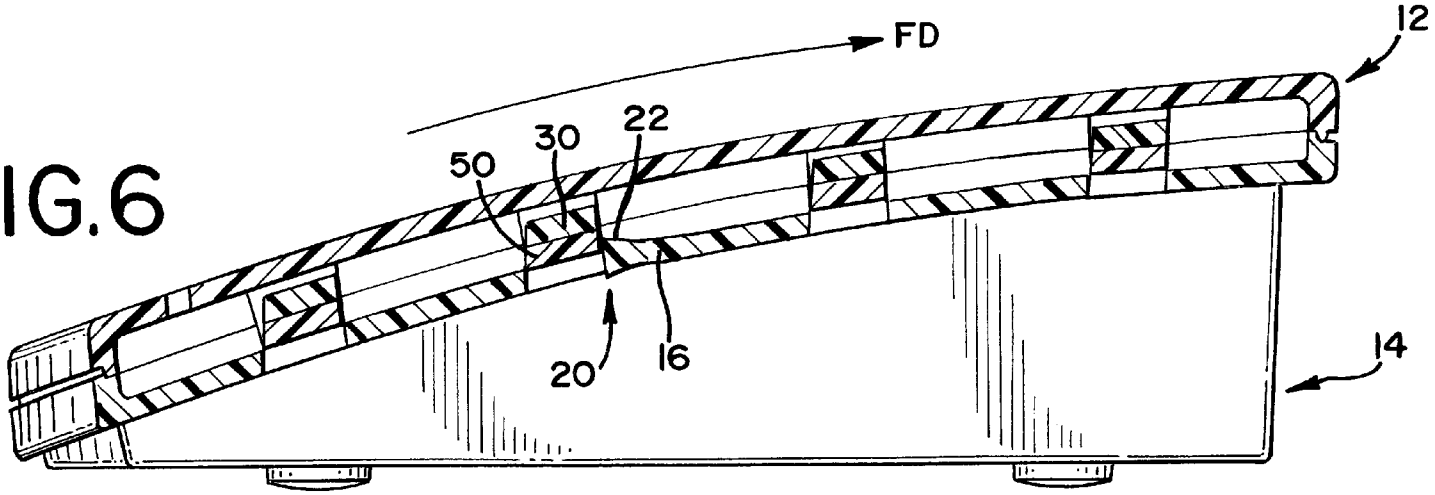
FIG. 6 is the embodiment of FIG. 4 showing top housing member engaged with the bottom housing member.

Referring to FIGS. 1 and 3, 5, the bottom housing member 14 includes at least one latch portion 16. As shown in FIG. 6, when the top housing member 12 is fully engaged with the bottom housing member 14, the latch portion 16 prevents movement of the top housing member 12 relative to the bottom housing 14 in a first direction (FD). As shown in FIG. 6, the first direction (FD) may preferably be an arcuate path that allows the top housing member 12 to disengage from the bottom housing member 14.

As shown in FIG. 1, the latch portion 16 is positioned along a perimeter portion 18 of the bottom housing member 14. The latch portion 16 may preferably be integrally formed with the bottom housing member 14. Alternatively, the latch portion 16 may be a separate member. As shown in FIGS. 1 and 3–6, the latch portion 16 may preferably include an end portion 20 having a rib portion 22. As shown in FIG. 1, the latch portion 16 may preferably be cantilevered from the perimeter portion 18 of the bottom housing member 14 so that it can be deflected when a force is applied to it. The latch portion 16 is positioned adjacent one side 24 of the bottom housing member 14. An identically configured second latch portion 26 may preferably be positioned adjacent the opposite side 28 of the bottom housing member 14.

Referring again to FIGS. 1 and 3–6, the bottom housing member 14 also includes at least one bottom housing retaining tab portion 30. The bottom housing retaining tab portion 30 may preferably extend outward from the perimeter portion 18 of the bottom housing member 14 and may preferably have an L-shaped configuration. However, alternative shapes and configurations of the bottom housing retaining tab portion 30 may be provided. The bottom housing retaining tab portion 30 may preferably be integrally formed with the bottom housing member 14. Alternatively, the bottom housing retaining tab portion 30 may be a separate member.

In the embodiment shown in FIG. 1, a plurality of bottom housing retaining tab portions 30, 32, 34, 36, 38, 40, 42, 44 are provided, four adjacent each of the sides 24, 28 of the bottom housing member 14. In the embodiment shown, the plurality of bottom housing retaining tab portions 30, 32, 34, 36, 38, 40, 42, 44 have the same configuration. The number of bottom housing retaining tab portions 30, 32, 34, 36, 38, 40, 42, 44 may vary depending upon the particular application. In the embodiment shown, the bottom housing retaining tab portions 30, 32, 34, 36, 38, 40, 42, 44 are spaced along the perimeter portion 18 of the bottom housing member 14.

Referring again to FIGS. 1 and 3–6, the top housing member 12 includes at least one top housing deflecting tab portion 50 for deflecting the latch portion 16. The top housing deflecting tab portion 50 is positioned along a perimeter portion 52 of the top housing member 12. The top housing deflecting tab portion 52 may preferably extend outward from the perimeter portion 52 of the top housing member 12 and may preferably have an L-shaped configuration. The top housing deflecting tab portion 50 may preferably be integrally formed with the top housing member 12. Alternatively, the top housing deflecting tab portion 50 may be a separate member. The top housing defecting tab portion 50 is oriented relative to the bottom housing retaining tab portion 30 to allow the top housing defecting tab portion 50 to be slidably engaged with the bottom housing retaining tab portion 30 in a second direction (SD) as shown in FIG. 5. The second direction (SD) may preferably be an arcuate path that allows the top housing member 12 to engage with the bottom housing member 14. The second direction (SD) may preferably be opposite the first direction (FD).

Slidably engaging the top deflecting tab portion 50 with the bottom housing retaining tab 30 portion secures the top housing member 12 to the bottom housing member 14 and prevents movement of the top housing member 12 relative to the bottom housing member 14. In particular, slidably engaging the top deflecting tab portion 50 with the bottom housing retaining tab portion 30 prevents movement of the top housing member 12 relative to the bottom housing member 14 in a third direction (TD). As shown in FIG. 3, the third direction (TD) may preferably be a vertical path that allows the top housing member 12 to separate from the bottom housing member 14.

In the embodiment shown in FIG. 1, a second top housing deflecting tab portion 54 for deflecting the second latch portion 26 is also provided. The second top housing deflecting tab portion 54, which as shown in FIG. 1 is configured the same as the top housing deflecting tab portion 50, may preferably be positioned opposite the top housing deflecting tab portion 50 adjacent the perimeter portion 52 of the top housing member 12. The top housing 12 member may further include at least one top housing retaining tab portion 56. The top housing retaining tab portion 56 may preferably be slidably engaged with the at least one of the bottom housing tab portions, and in particular, bottom housing tab portion 44. In the embodiment shown, six top housing retaining tab portions 56, 58, 60, 62, 64, 66 are provided, three on each side of the top housing member 12. The six top housing retaining members 56, 58, 60, 62, 64, 66 slidably engage with six of the bottom housing retaining tabs 44, 42, 40, 32, 36, 38, respectively, to further secure the top housing member 12 to the bottom housing member 14 and prevent movement of the top housing member 12 relative to the bottom housing member 14.

Figure 4:
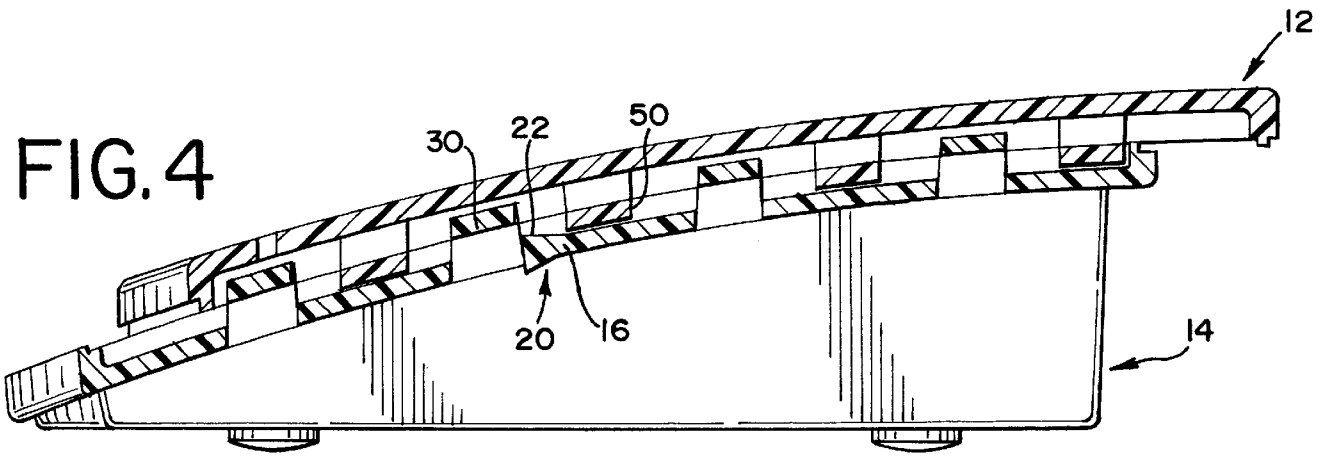
FIG. 4 a sectional view showing the top housing member positioned against the bottom housing member in the disengaged position.

To assemble the enclosure 10, the top housing member 12 is positioned against the bottom housing 14 member as shown in FIG. 4. At this point, the latch portion 16 is in an undeflected state. The top housing deflecting tab portion 50 is slidably engaged with the bottom housing retaining tab portion 30 in the second direction (SD) as shown in FIG. 5. As shown in FIG. 5, the latch portion 16 is deflected by the top housing deflecting tab portion 50. As shown in FIG. 6, when the top housing deflecting tab portion 50 is in full contact with the bottom housing retaining tab portion 30 and passes over the end portion 20 of the latch portion 16, the latch portion 16 returns to its undeflected state. When the top housing member 12 is fully engaged with the bottom housing member 14 as shown in FIG. 6, the latch portion 16 prevents movement of the top housing member 12 relative to the bottom housing member 14 in the first direction (FD). The top housing deflecting tab portion 50 and the bottom housing retaining tab portion 30 secure the top housing member 12 to the bottom housing member 14 and also prevent movement of the top housing member 12 relative to the bottom housing member 14 in the third direction (TD) (see FIG. 3). The advantage of this arrangement is that the latch portion 16 is not relied upon to prevent movement of the top housing member 12 relative to the bottom housing member 14 in the third direction (TD). As a result, the latch portion 16 is not susceptible to failure when the enclosure 10 is subjected to forces exerted during impact testing. Moreover, the top housing member 12 and the bottom housing member 14 are less likely to separate from one another during impact testing due to the interlocking nature of the top housing deflecting tab portion 50 and the bottom housing retaining tab portion 30. In particular, if a force is applied to the top housing member 12, the top housing deflecting tab portion 50 is forced against the bottom housing retaining tab portion 30 thereby forcing the top housing member 12 and the bottom housing member 14 together.

To disassemble the enclosure, the latch portion 16 is deflected. The top housing member 12 is slidably moved relative to the bottom housing member 14 in the first direction (FD) (see FIG. 6). When the top housing deflecting tab portion 50 is no longer in contact with the bottom housing retaining tab portion 30, the top housing member 12 can be disengaged from the bottom housing member 14.

One advantage of the present invention is that it eliminates the high insertion forces associated with conventional latching mechanisms. In particular, the force required to slide the top housing member 12 onto the bottom housing member 14 is relatively low because only two latch portions 16, 26 have to be deflected. Similarly, the force required to dissemble the top housing member 12 from the bottom housing 14 member is also greatly reduced. Finally, the top housing member 12 and the bottom housing member 14 can be assembled and disassembled many times without mechanical degradation of the latch portions 16, 26.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A method of operating a locking mechanism for a modem enclosure comprising:

providing a top housing member and a bottom housing member, the bottom housing member including at least one latch portion attached to a periphery thereof, the top housing member including at least one L-shaped top housing deflecting tab portion, the bottom housing member including at least one inverted L-shaped bottom housing retaining tab portion;

deflecting the at least one latch portion with the at least one top housing deflecting tab portion;

slidably engaging the at least one top housing deflecting tab portion with the at least one bottom housing retaining tab portion in a second direction;

securing the top housing member to the bottom housing member;

allowing the at least one latch portion to return to an undeflected condition;

preventing movement of the top housing member relative to the bottom housing member in a first direction wherein the first direction is an arcuate path that allows the top housing member to disengage from the bottom housing member; and preventing movement of the top housing member relative to the bottom housing member in a direction normal to the first and second direction.

2. The method of claim 1 wherein the second direction is an arcuate path that allows the top housing member to engage with the bottom housing member.

3. The method of claim 1 wherein a third direction is a vertical path that allows the top housing member to separate from the bottom housing member.

4. The method of claim 1 further comprising:

positioning the top housing member against the bottom housing member.

5. The method of claim 1 further comprising:

contacting the at least one top housing deflecting tab portion with the at least one bottom housing retaining tab portion.

6. The method of claim 1 further comprising:

deflecting the at least one latch portion to allow movement of the top housing member relative to the bottom housing member in the first direction; and, disengaging the top housing member from the bottom housing member.

7. A method of operating a locking mechanism comprising:

providing a top housing member and a bottom housing member, the bottom housing member including at least one integrally formed deflectable latch portion, the top housing member including at least one integrally formed rigid L-shaped top housing deflecting tab portion, the bottom housing member further including at least one integrally formed rigid inverted L-shaped bottom housing retaining tab portion;

deflecting the at least one integrally formed deflectable latch portion with the at least one integrally formed rigid top housing deflecting tab portion;

slidably engaging the at least one integrally formed rigid top housing deflecting tab portion with the at least one integrally formed rigid bottom housing retaining tab portion;

securing the top housing member to the bottom housing member;

allowing the at least one integrally formed deflectable latch portion to return to an undeflected condition; and preventing movement of the top housing member relative to the bottom housing member.

* * * * *